US005639053A

United States Patent [19]

Dmitriev

[11] Patent Number: 5,639,053

[45] Date of Patent: Jun. 17, 1997

[54] HOLDER FOR READING AND VIEWING WRITTEN AND OTHER MATTER

[76] Inventor: Alex Dmitriev, 304 W. 89th St. #7A, New York, N.Y. 10024-2102

[21] Appl. No.: 557,412

[22] Filed: Nov. 13, 1995

[51] Int. Cl.[6] ..... A47B 97/04

[52] U.S. Cl. ..... 248/460; 248/453

[58] Field of Search ..... 248/460, 461, 248/453, 465, 455

[56] References Cited

U.S. PATENT DOCUMENTS

| | | | |
|---|---|---|---|
| 3,269,043 | 8/1966 | Swanson | 248/460 |
| 4,150,807 | 4/1979 | Manso | 248/460 |
| 4,978,096 | 12/1990 | Struckmann | 248/461 |
| 5,492,299 | 2/1996 | Thermos et al. | 248/465 |

*Primary Examiner*—Leslie A. Braun
*Assistant Examiner*—Willie Berry, Jr.

[57] ABSTRACT

A device, that is collapsible and portable, for the holding and viewing of books and other matter in an upright reading position on a horizontal surface. It is comprised of a main book support (10), a proportionally shorter support member (12), and a book rest (14). Two tabs (16*a&b*), on the book rest (14), hold a book or other matter against the main book support (10). The device is hinged (18 and 20) in such a manner that the support member (12) and the book rest (14) can only extend to a predetermined degree relative to the main book support (10). In the closed position, they rest snug against the main book support (10) and the return (30) on their respective sides, creating a compact unit for easy storage or transport.

3 Claims, 2 Drawing Sheets

HOLDER FOR READING AND VIEWING WRITTEN AND OTHER MATTER

BACKGROUND

1. Field of Invention

This invention relates to book holders, specifically to such book holders that are collapsible and portable.

2. Description of Prior Art

A review of the prior art in this field shows a multitude of proposed solutions to the reader's need to find a simple and convenient device for holding up a book or other written material. Readers everywhere, whether in a library, at their desks, or in a lunch room, look for a means to hold or prop up their reading material so that their hands are free to make notes or eat a sandwich.

Unfortunately none of the past or present efforts have adequately resolved this need in every instance or in all ways.

In the past, many of these devices were invented to hold or support large hardcover books at a stationary location. In this day of paperback books, readers need a holder that they can carry as easily as the book itself. A holder that can be easily used at a variety of locations. Prior art that does not address the present needs is as follows:

U.S. Pat. No. 3,897,037 (Johnson) is designed for use with paperback books but requires attachment of a support member for use as a display. U.S. Pat. No. 2,642,190 (Kelly) is constructed of one piece of sheet metal and does not collapse and does not lend itself to portability as it was designed to be a rack or display stand. U.S. Pat. No. 3,952,989 (Hatcher) and U.S. Pat. No. 3,991,967 (Sack) are overly complicated and do not lend themselves to portability.

U.S. Pat. No. 3,954,246 (Sparkman) is constructed of a heavy gage wire and in the collapsed position is not secure against unfolding during transport. U.S. Pat. No. 4,116,413 (Anderson) is a collapsible stand but is bulky and does not allow for quick and easy turning of the pages. U.S. Pat. No. 4,123,029 (Gillotti) is not collapsible and not readily portable. U.S. Pat. No. 4,296,946 (Larre) requires the manipulation of a cord in order to turn the pages. U.S. Pat. No. 3,007,278 (Million) is difficult to manage in that the wire frame is loosely held by plastic connectors and moves easily so that any book held can move or be dislodged from the frame. U.S. Pat. No. 4,105,182 (Jacobson) a multiple use device made of cardboard is too large and unnecessarily complicated.

As this review of relevant prior art shows, there has not been a satisfactory solution to a reader's need to have an inexpensive, collapsible and portable book holder that is easy to set up and use. The present invention is directed to the meeting of this unfulfilled need.

OBJECTS AND ADVANTAGES

The present invention provides an inexpensive, easily constructed and versatile holder for written material such as magazines, paperback books, hardcover books and even handwritten notes. Accordingly several objects and advantages of the present invention are that:

(a) it is a simple, light weight device that may be used to hold and support a book or other matter on a level surface such as a table or the like.

(b) it can be used with books or other matter of different dimensions.

(c) it provides a light weight, inexpensive holder that is compact, collapsible and may be easily transported and stored.

(d) it provides a relatively inexpensive device to manufacture and to assemble.

(e) it provides a holder that is quickly erected and used.

(f) it provides a holder that allows the reader to turn pages quickly and with ease.

(g) it provides a holder whose page tabs are of a transparent nature.

(h) it can be manufactured in different shapes and colors.

(i) it can also be easily setup and used by the elderly or infirm.

Still further objects and advantages will become apparent from consideration of the ensuing drawings and description.

DRAWING FIGURES

A full understanding of the invention will be facilitated by referring to the drawings, in which like numbers refer to like parts in the several views, and in which closely related figures have the same number but different alphabetic suffixes.

Reference Numerals in Drawings

Figure 1:
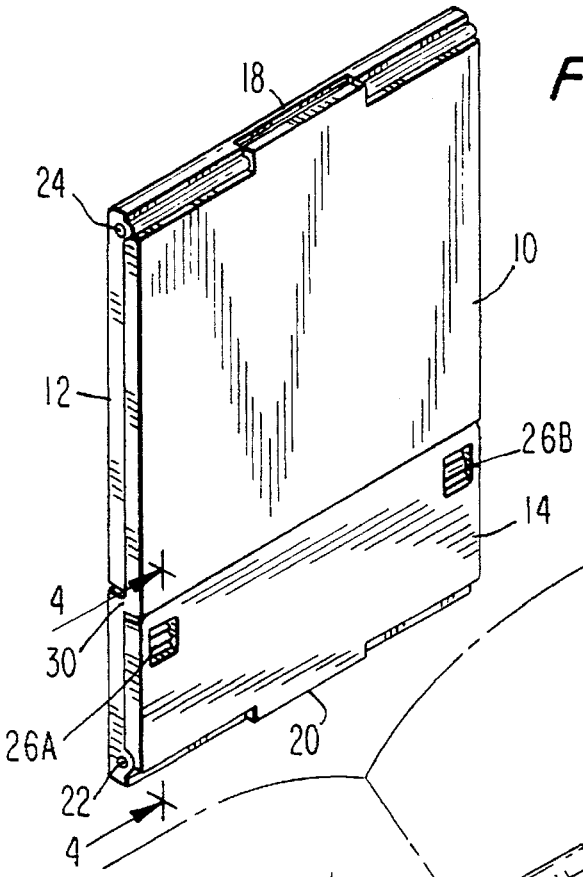
FIG. 1 shows the holder in a closed position.

| | |
|---|---|
| 10 main book support | 12 support member |
| 14 book rest | 16 a&b tabs |
| 18 upper hinge | 20 lower hinge |
| 22 lower hinge dowel | 24 upper hinge dowel |
| 26 a&b tab holders | 28 a&b tab receptacles |
| 30 90 degree return on main book support | |

DESCRIPTION

Understanding of the invention will be further aided by examining a specific embodiment of the forgoing device in greater detail. As shown in the drawing FIG. 1 the holder, in this embodiment, comprises generally a rectangular shape. It is formed from a sufficiently rigid material to prevent distortion in ordinary use.

The present invention is comprised of three main parts, all of the same thickness and ideally of the same width. The first is a main book or other matter support 10 which is of a predetermined length and thickness. This main support 10 has, at a predetermined location 30, a 90 degree return traveling a distance equal to the predetermined thickness. At that point, it turns 90 degrees again in a downward direction.

The second part is a supporting member 12 which extends from the upper back side of the main book support. The third part is a book rest 14 which extends from the lower front side of the main book support.

Figure 2:
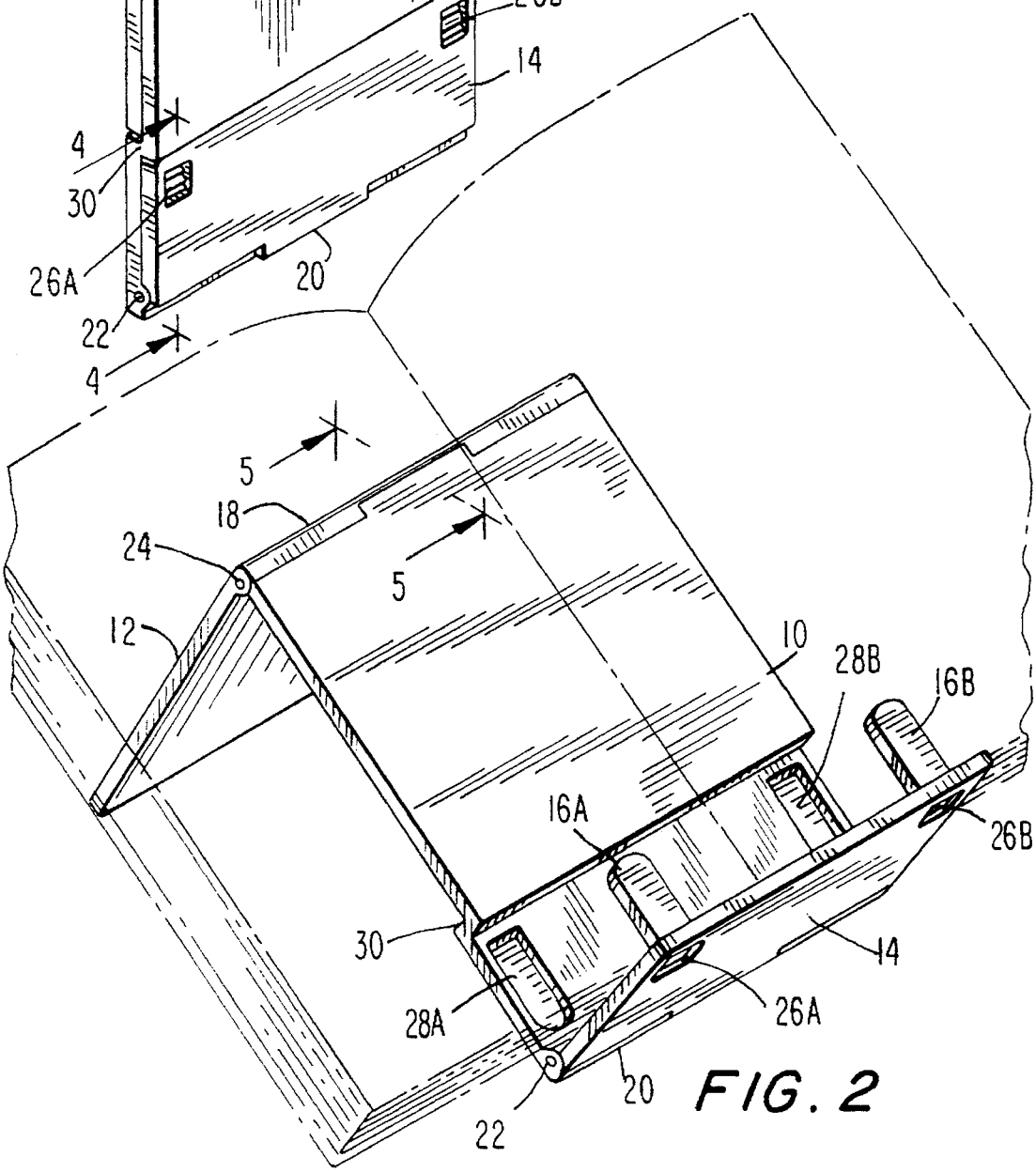
FIG. 2 shows the holder in the open position.
Figures 3, 4, 5:
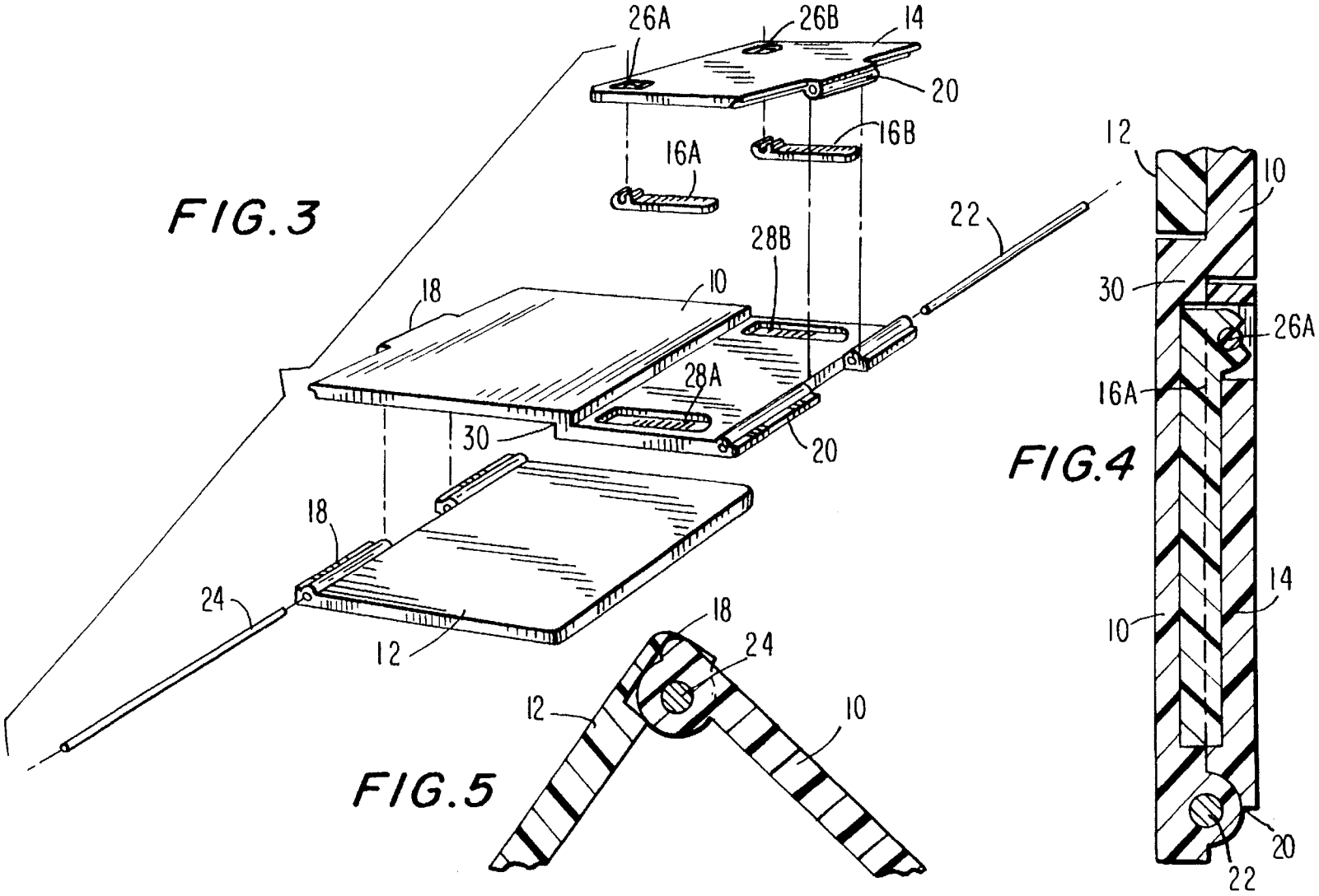
FIG. 3 shows an exploded view of the holder.
FIG. 4 shows a cross section of the lower hinge, the book rest with tab and tab holder and receptacle.
FIG. 5 shows a close-up of the upper hinge.

The support member 12 and the book rest 14 are hinged 18 and 20 to the main book support 10 in such a manner that in the closed position FIG. 1 they rest against the main book support 10 on their respective side, their ends fitting snugly against the return 30 on their respective sides, creating a compact profile. When extended as seen in FIG. 2 they can only extend to a predetermined angle. In the case of the book rest 14 it stops at an angle perpendicular to the vertical of the main book support 10.

The support member 12 which is proportionally shorter than the main book support 10 also extends to a predetermined angle so that in its extended position it will, when its bottom edge is placed on a flat surface, cause the holder to tilt rearward at a predetermined angle. See FIG. 2.

The book rest 14, also proportionally shorter than the main book support 10, has, attached to it, two tabs 16*a* and 16*b*, made of a transparent material, that can lie flat on the upper surface of the book rest 14. When the book rest 14 is in its closed position FIG. 1, the tabs 16*a* and 16*b* are within the tab receptacles 28*a* and 28*b* on the surfaces of the main book support 10 and the book rest 14. When the book rest 14 is in its extended position FIG. 2, the tabs 16*a* and 16*b* can be pivoted on the tab holders 26*a* and 26*b* to a vertical position.

OPERATION - FIGS. 1, 2

One of the obvious advantages of this invention is its ease of operation. All that a reader needs to do in order to set up the holder to receive whatever matter the reader wants to view is to take hold of the main book support 10 with one hand and with another hand move the support member 12 out to its predetermined position and place the holder on a level surface. The book rest 14 is then moved to its predetermined position and the tabs 16*a&b* are extended to the vertical and the reading material placed on the book rest 14 and against the main book support 10. The reverse procedure is used to close the holder up to make it ready for storage or transport to a different location.

SUMMARY, RAMIFICATIONS, AND SCOPE

This ease of operation and the inherent versatility of this holder makes it a valuable aid to readers troubled with many types of infirmity, as well for students at the library or workers at their computers copying material into a report or other project. Cooks would find this holder especially valuable in keeping cookbooks open in order to follow a recipe.

It will also be recognized that the specific illustrative holder described is subject to a broad spectrum of variations without departing from the spirit of the invention. For example, while keeping the basic integrity of the proportions and how the hinges work, the shape of the holder does not need to be rectangular. It can also be manufactured out of a variety of materials, plastics, wood or other such material that would provide sufficient rigidity to maintain the desired strength and stability. It can also be manufactured using a combination of different materials. It can as well, depending on the material used, be manufactured in different colors and with designs representative of any specific idea desired.

Numerous other modifications are clearly within the skill of the art. Accordingly, the scope of the invention is defined only by the following claims, with full reference to the doctrine of equivalents.

I claim:

1. A compact, folding, portable device for holding and viewing books and other matter comprising of:

a sheet of a rigid plastic or other material of a predetermined length, width and thickness having a front and back side;

said sheet of rigid plastic or other material having attached to it by means, at its upper and lower edges, a piece of rigid plastic or other material of a proportional length, and predetermined width and thickness;

said proportional pieces of rigid plastic or other material are connected to the sheet of rigid plastic or other material by means allowing said attached proportional pieces of rigid plastic or other material to pivot to open and closed positions of a predetermined angle;

said attached pieces are connected by means whereby the proportional piece attached to the upper edge of said sheet of rigid plastic or other material pivots to a closed and flush position along the back side of said sheet of rigid plastic or other material;

and said proportional piece of rigid plastic or other material attached by means to the lower edge of the sheet of rigid material to pivot to a closed and flush position along the front side;

attached to said proportional piece of rigid plastic or other material, at the outer edge, are two tabs, of a transparent plastic or similar material, which can by means pivot from a horizontal to a vertical position from the plane of said proportional piece of rigid plastic or other material said sheet of a rigid plastic or other material having a 90 degree return having a distance equal to said predetermined thickness whereby each of said pieces of rigid plastic on other material is adapted to be stored within its own recess formed by said return.

2. The device of claim 1 wherein the proportional piece of rigid plastic or other material, connected by a hinge to the upper edge of the sheet of rigid plastic or other material, when in an open position allows the holder to tilt back to a predetermined angle.

3. The device in claim 1 wherein all the hinges are by means designed to stop at a predetermined point thereby locking the device at predetermined angles to its members.

* * * * *